United States Patent [19]

Gundlach

[11] 4,007,682

[45] Feb. 15, 1977

[54] REVERSE ANGLE MOUNTED INK-SPLITTING DOCTOR BLADE

[75] Inventor: Robert W. Gundlach, Victor, N.Y.

[73] Assignee: Xerox Corporation, Stamford, Conn.

[22] Filed: July 7, 1975

[21] Appl. No.: 593,826

Related U.S. Application Data

[63] Continuation-in-part of Ser. No. 463,487, April 24, 1974, abandoned.

[52] U.S. Cl. ..... 101/348; 101/350; 118/261

[51] Int. Cl.[2] ..... B41F 31/06

[58] Field of Search ..... 101/157, 169, 350, 365, 101/348, 349, 132, 141, 450, 212, 213, 216; 118/261; 15/256.5, 256.51

[56] References Cited

UNITED STATES PATENTS

| | | | |
|---|---|---|---|
| 194,218 | 8/1877 | Campbell | 101/350 X |
| 2,042,943 | 6/1936 | Hoyle | 101/365 |
| 2,232,274 | 2/1941 | Robbins | 101/365 X |
| 2,530,282 | 11/1950 | Brodie et al. | 101/350 |
| 2,998,841 | 9/1961 | Rowe | 118/261 |
| 3,613,578 | 10/1971 | Heurich | 101/350 |
| 3,818,830 | 6/1974 | Schultz | 101/350 |
| 3,866,266 | 2/1975 | Dunlap | 101/169 X |
| R24,161 | 6/1956 | Rogge et al. | 101/157 |

*Primary Examiner*—Edgar S. Burr
*Assistant Examiner*—R. E. Suter
*Attorney, Agent, or Firm*—James J. Ralabate; James P. O'Sullivan; Jerome L. Jeffers

[57] ABSTRACT

Disclosed is an improved method for the inking of an inking roller in conventional printing techniques. The method involves applying an ink film to the inking roller which is everywhere thicker than the desired thickness and applying a doctor blade, mounted at a reverse angle, to the ink to split it and apply it to the roller in the desired thickness when relative motion is provided between the roller and the doctor blade.

1 Claim, 2 Drawing Figures

REVERSE ANGLE MOUNTED INK-SPLITTING DOCTOR BLADE

This application is a continuation-in-part of said application Ser. No. 463,487, which application is now abandoned.

BACKGROUND OF THE INVENTION

Reference is hereby made to the following copending applicaton, the benefits of whose filing date is claimed: application Ser. No. 463,487, filed on Apr. 24, 1974.

Conventional letterpress and lithographic presses apply ink to the printing surface by contacting the printing roller with an inking roller, sometimes referred to as the form roller, to thereby maintain a supply of ink on the printing surface. Most printing masters are sensitive to the thickness of the ink applied to them. If the roller supplying ink to the master carries an ink film that is not uniform, the non-uniformities are carried to the resulting print. Conventional presses using such inking systems suffer from a disadvantage in that the inking roller retains a memory, or ghost, of the last image printed. This is the case because on each inking cycle the master extracts about half of the film of ink in the printing (character) areas. The differences in ink film thickness between image and background areas immediately after this extraction is reduced by a factor of two when the form roller is re-inked from the ink supply train. Nevertheless, under some conditions, a detectible and objectionable "ghost" is seen in the subsequent print.

In addition to print-by-print ghosts, longer run non-uniformities exist when the ink is consumed more heavily in some areas than in others. This can be corrected by careful adjustments in ink delivery to match any non-uniformity of consumption. A long response time to reach equilibrium makes such adjustments time consuming and wasteful.

It is an object of the present invention to provide a novel process for the inking of printing surfaces.

A further object is to provide such a process which is especially useful when the printing surface is in the form of a roller or drum.

An additional object is to provide such an inking process in which the aforementioned "ghosting" problem is reduced or eliminated.

Another object is to provide such a process which eliminates the problem of long response times in adjusting ink delivery to match non-uniformity of consumption.

SUMMARY OF THE INVENTION

The present invention is an improved method of inking a cylindrical surface to the desired ink thickness. The improvement comprises:

a. applying a flexible doctor blade, having an edge capable of splitting the ink thereby causing a portion of the ink to flow above the blade and a portion of the ink to flow beneath the blade, to the lead edge of the cylindrical surface and parallel with the axis of rotation of the cylinder to form a nip roughly the thickness of the ink film to be formed, said doctor blade being supported by a support member and pressed against the ink film by said support member in such a manner that the angle between the lead edge of the surface and the blade at their point of nearest approach is greater than 90° and less than 180°;

b. applying ink to the doctor blade and causing a portion of it to flow over the lead edge of the doctor blade and onto the surface to form an ink film on the surface which is thicker than the desired ink film thickness; and c. providing relative motion between the surface and the doctor blade at a velocity adjusted to interact with the ink viscosity, blade geometry and downward force on the blade to cause the ink to be carried into the nip by such relative motion whereby its viscous resistance to shear forces creates an upward pressure causing the doctor blade to float over the ink film it produces when a portion of the ink flows above the blade and a portion of the ink flows beneath the blade to cause the ink to be applied to the surface in the desired thickness.

The surface inked in this manner is then contacted with a printing master such as a flexible lithographic master or those used in flexography or Letterflex printing to impart a uniform supply of ink to the master. When carried out in a cyclic manner, the method provides an inking system which is independent of variations in ink thickness created during the previous cycle. Typically, the surface to be inked by the process of the present invention is in the form of a roller or drum so that the inking and printing is employed under cyclic conditions. Since the ink film thickness will be in the order of 5 to 30 microns, it is unlikely that two rigid surfaces would be flat enough to insure contact in all areas. Therefore, either the form roller or the printing master should be flexible so that when the process is used to ink a rigid printing master as in letterpress or conventional lithographic techniques, a flexible inking roller is employed.

DETAILED DESCRIPTION

Figure 1:
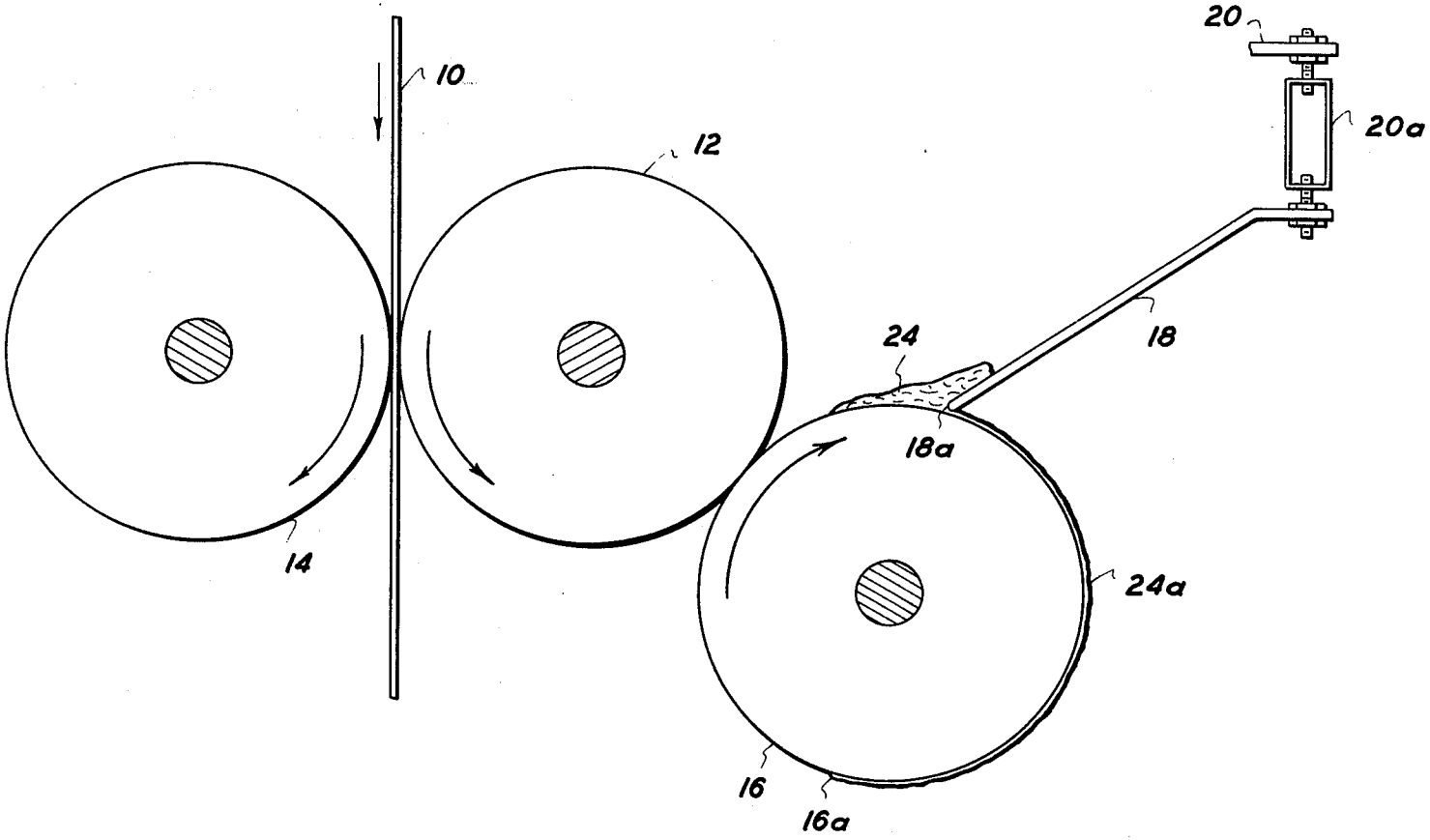
FIG. 1 represents the method of practicing the invention by depicting the initial inking of the roller.

Referring to the drawing, a receiving web 10 is illustrated as moving vertically downward between the printing roller 12 and the backup roller 14. The inking roller 16 is mounted under and in close proximity to the doctor blade 18 which is supported by support member 20. The downward pressure applied to the doctor blade is adjusted by adjusting means **20*a* which is illustrated in the drawing as a turn buckle. The doctor blade is mounted so that the angle between the lead edge of the roller to be inked and the blade is greater than 90° and less than 180°. In addition, the blade is mounted so that its lead edge is parallel to the axis of rotation of the drum. In the embodiment illustrated by the drawing, the angle between the roller and blade is determined by drawing an imaginary line tangential to the roller 16 at the point of nearest approach between the drum and the doctor blade. This configuration is conveniently referred to as reverse angle mounting since the point of contact is the lead edge of the blade as opposed to the trailing edge as in the case of a conventional trailing doctor blade. Reverse angle mounting, as used herein, insures that the ink coating thickness is independent of residual ink from the previous cycle so long as more than enough ink is added during each cycle. An ink supply 24 is applied to the roller and doctor blade so that when relative motion is provided between the roller and the blade by turning the roller in a clockwise direction, the ink is split by the edge of the blade designated as 18***a*. The blade edge 18*a* need not be of any particular shape, but as will be hereinafter described, blade edge geometry can be adjusted to assist in providing the desired ink thickness. When the roller 16 is rotated, ink pressure generated by viscous resistance to shearing forces maintains a uniform spacing between the doctor blade and the roller and thereby forms a uniform layer of ink on the roller. The thickness of the film can be increased or decreased by adjusting the downward pressure with adjusting means 20*a*. Thus, when a thinner ink layer is desired, the downward pressure is increased, and less pressure is applied when a thicker layer of ink is desired. Other factors, i.e. velocity of the relative motion between the surface and the blade, ink viscosity and the geometry of the blade edge, all interact with the downward force applied to the blade to affect the thickness of the ink film. Thus, for a given ink viscosity, blade geometry and downward force the thickness of the ink film is determined by the velocity of the relative motion which is conveniently controlled by adjusting the rate at which the drum is rotated. Setting the first three variables and turning the roller at a rate designed to provide the velocity of relative motion necessary to provide the desired ink thickness insures that the thickness of the ink coating is independent of residual ink from the previous cycle and is applied in a film of the desired thickness. Alternatively, the velocity of relative motion, ink viscosity and blade geometry can be pre-set and the downward pressure on the blade adjusted to provide an ink film of the desired thickness.

Providing the requisite amount of ink which will in each case be more than is needed to form the ink film on the roller is readily accomplished by maintaining sufficient ink 24 on the doctor blade 18 to cover its edge 18*a* and flow down over that part of the roller 16 which is in close proximity to the doctor blade. Ink is conveniently supplied by applying it to the doctor blade surface and allowing it to flow down over the edge. Referring again to the drawing, the inking roller 16 is represented as having been provided with a uniform coating of ink 24*a* along one-half of its circumference up to point 16*a* by rotating it 180°. Rotation of an additional 180° will bring the inked portion in contact with the printing roller to impart a supply of ink thereto and return the lead edge of the inking roller to close proximity with the doctor blade. At this point, the ink film will be non-uniform in thickness due to consumption of ink in the areas corresponding to the image bearing areas of the printing master. However, as the roller continues its rotation so that point 16*a* travels past the doctor blade, it is again provided with an even layer of ink. Thus, as long as the ink supply 24 is maintained at an adequate level, any number of printing cycles can be carried out without running into the difficulties previously described as being inherent in conventional inking systems. The angle between the doctor blade and the lead edge of the surface can be of any value provided that it is greater than 90° and less than 180°. When the ink is gravity fed, a very viscous ink will require a steep angle approaching the 12 o'clock position whereas a shallow angle approaching the 3 o'clock position will be used for a less viscous ink.

In another embodiment, ink flow is promoted by means other than gravitational force such as by intermittent use of an extruder. A photocell or other automatic monitoring device can be used to maintain the ink supply at the proper level.

The lead edge of the doctor blade should be blunt or rounded as opposed to being sharp when less viscous inks are used since the purpose of the blade coater is to apply a film between the blade and the roller. If a blade with a sharp edge is used with less viscous inks, it may gouge the roller since the downward pressure exerted against the blade would tend to be greater than hydrostatic lifting forces exerted by the ink against the blade edge. Conversely, when an ink of high viscosity is used and the rate of relative motion is high, even a sharp blade will "float" along on the ink surface. Blade edge geometry will play a role in determining the ink film thickness since the amount of blade surface contacting the ink at the nip, i.e. the region between the lower surface of the doctor blade and the inking roller in which the ink exerts a pressure, will play a part in determining the upward shear force exerted against the blade by the ink which should offset the downward force exerted against the blade to the extent necessary to cause an opening between the blade and roller sufficient to provide an ink film of desired thickness.

Figure 2:
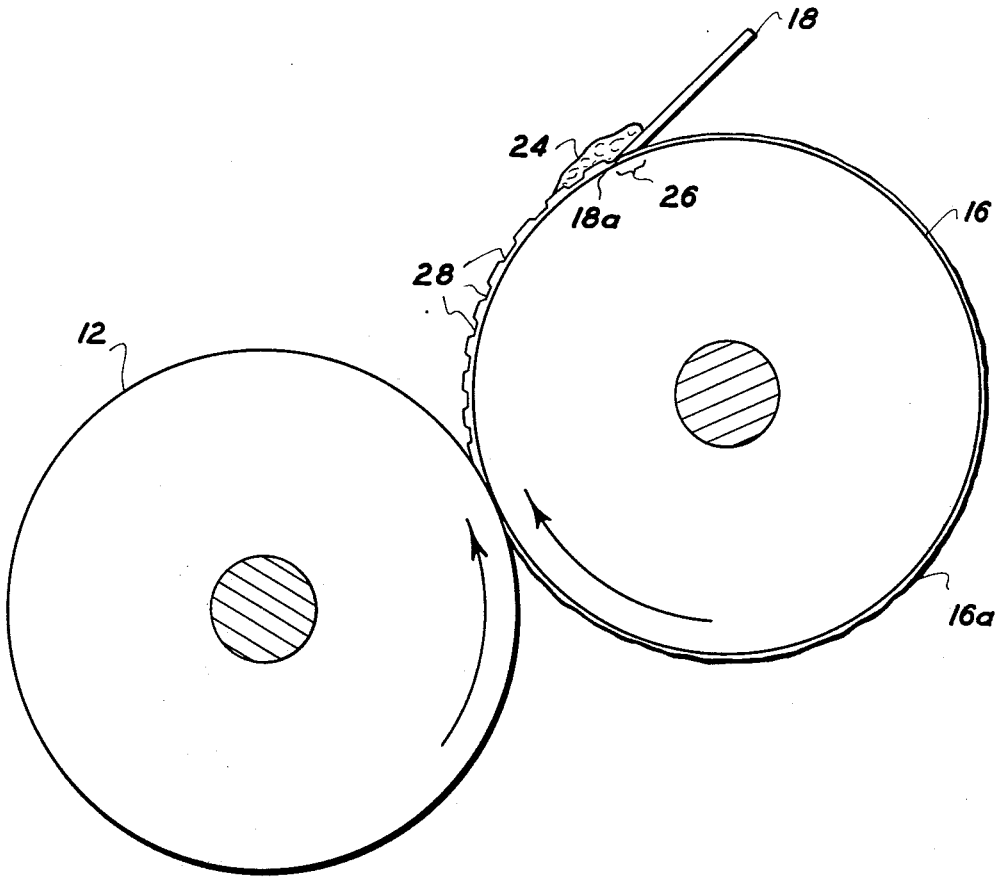
FIG. 2 represents the reinking of the roller, after the initial printing run, using a doctor blade with a wedge-shaped edge.

The invention is further illustrated by FIG. 2 in which the blade edge 18*a* is wedge shaped and is shown as riding on the ink at the nip 26. As the inking roller 16 rotates past its point of contact with the printing roller 12, depressions 28 are left in the ink film corresponding to the character configuration on the printing roller since the ink adheres to the character areas (not shown) on the printing roller. As the inking roller rotates, the depressions come in contact with the ink supply 24 and are filled to provide an even film of ink as the roller turns to move the depressions past the doctor blade 18.

As previously mentioned, the shear forces exerted against the blade will be affected by the ink viscosity and doctor blade geometry. The wedge shaped blade edge illustrated in FIG. 2 is suitable for use with inks of high viscosity with relatively rapid drum rotation. A blade with a rounded edge having a radius of curvature of one-half the blade thickness is preferred for use with less viscous inks.

It has been found that a number of configurations and materials can be made to work according to the principles of the present invention. The doctor blade is basically a flexible member supported against the lead edge of the inking roll to form a wedge shaped nip roughly the size of the desired ink film to be formed. The surface of the doctor blade on the entrance side of the nip is inclined to form a cradle with the lead edge of the inking roll, and this cradle is filled with a viscous ink. The ink flows onto the inking roller by gravitational forces and is carried into the wedge shaped nip by the movement of the inking roller where its viscous resistance to shear creates a pressure causing the doctor blade to "float" or "plane" over the ink film is produces.

The invention is further illustrated by the following examples:

EXAMPLE I

A Swedish steel blade 0.015 inch thick and extending 1 inch from a rigid mounting means is shaped to have a cylindrical edge with a 0.0075 inch radius of curvature. The blade is positioned to contact a flexible inking roller 20° from the top (12 o'clock position) of the roller. The blade is supported at an angle of 173° relative to the tangent at the lead edge of the roller. A total force of 7.6 pounds is applied along the 10 inch length of the blade to provide a downward pressure of 0.76 pounds per linear inch.

Ink is applied to the lead edge of the blade in sufficient quantity to keep the nip between the blade and the inking roller continuously supplied with a film of ink at an operating speed of 90 inches per second. The ink is obtained from the Ron Ink Company of Rochester, New York, under the designation XL 91779, and found to have a room temperature viscosity of 180,000 centipoise and a tack value of 196 as measured on a Thwing Albert 101 Inkometer.

The ink roller is contacted with a waterless lithographic master as the printing roll and the rolls rotated in unison at 90 inches per second. As the inking roller rotates past the ink supply and doctor blade, a smooth ink coating is applied to the roller so that when the printing roller contacts the inking roller, dense, uniform, ghost-free inking results and is maintained through any number of printing cycles.

Both viscosity and tack of most inks drop with temperature increases, and this is the case during press operation. However, the total acceptable range of adjustments either to roller speed or downward pressure on the blade is enough to accommodate practical changes encountered in normal operation.

EXAMPLE II

A Swedish steel blade 0.008 inch thick having a cylindrical edge with a 0.004 inch radius of curvature is mounted in relation to the inking roller as in Example I. The ink, which is obtained from the Ron Ink Company under the designation EX-85, is found to have a room temperature viscosity of 178,000 centipoise and a tack value of 17.3. Rotation of the inking roller at 14 inches per second provides a uniform coating of ink 5 microns thick.

EXAMPLE III

The doctor blade described in Example II is mounted as previously described except that it contacts the inking roller at an angle of 30° from the top. The ink is obtained from the Van Son Ink Company under designation 10850 and found to have a room temperature viscosity of 61,400 centipoise and a tack value of 20.1. Rotation of the inking roller at 68 inches per second provides a uniform coating of ink 5 microns thick.

EXAMPLE IV

The process described in Example III is repeated with the exception that the rotation speed of the inking roller is increased to 172 inches per second to provide an even layer of ink 12 microns thick on the inking roller.

EXAMPLE V

The process of Example I is repeated with the exception that a rigid inking roller and a flexographic master are employed. Application of a uniform 15 $\mu$ layer of ink to the inking roller with subsequent contact of the inked roller and flexographic printing master results in dense, uniform, ghost-free inking of the master.

What is claimed is:

1. In the method of inking the surface of a cylinder to the desired ink thickness the improvement which comprises:

a. applying a flexible doctor blade, said blade having a cylindrical edge capable of splitting the ink thereby causing a portion of the ink to flow above the blade and a portion of the ink to flow beneath the blade and said cylindrical blade edge having a radius of curvative one-half of the blade thickness, to the surface of the cylinder and parallel with the axis of rotation of the cylinder to form a nip roughly the thickness of the ink film to be formed, said doctor blade being supported solely by a support member and pressed against the ink film by said support member so that the angle between the cylinder and the blade at their point of nearest approach is greater than 90° and less than 180°;

b. applying ink having a room temperature viscosity no greater than about 180,000 centipoise and a tack value no greater than about 196 as measured on a Thwing Albert 101 Inkometer to the doctor blade and causing a portion of it to flow over the edge of the blade and onto the surface of the cylinder to form an ink film on said surface which is thicker than the desired ink film thickness; and c. providing relative motion between the surface of the cylinder and the doctor blade at a velocity adjusted to interact with the ink viscosity, blade geometry and downward force on the blade to cause the ink to be carried into the nip by such relative motion, whereby its viscous resistance to shear forces creates an upward pressure causing the doctor blade to float over the ink film it produces when a portion of the ink flows above the blade and a portion flows beneath the blade to thereby cause the ink to be applied to the surface in the desired thickness.

* * * * *